US006609310B2

(12) United States Patent
Carnovale

(10) Patent No.: US 6,609,310 B2
(45) Date of Patent: Aug. 26, 2003

(54) METHOD AND APPARATUS FOR SAFETY CONTROL OF THE DRYING CYCLE IN HYDROCARBON-SOLVENT DRY-CLEANING MACHINES

(75) Inventor: Salvatore Carnovale, S. Croce di Carpi (IT)

(73) Assignee: Donini International S.p.A., Bologna (IT)

( * ) Notice: Subject to any disclaimer, the term of this patent is extended or adjusted under 35 U.S.C. 154(b) by 0 days.

(21) Appl. No.: 09/867,413

(22) Filed: May 31, 2001

(65) Prior Publication Data

US 2001/0049885 A1 Dec. 13, 2001

(30) Foreign Application Priority Data

Jun. 6, 2000 (IT) ..... BO2000A0337

(51) Int. Cl.[7] ..... F26B 3/00

(52) U.S. Cl. ..... 34/499; 34/595; 34/348; 34/446; 34/454; 34/134

(58) Field of Search ..... 34/497, 498, 499, 34/595, 134, 329, 330, 337–343, 348–352, 357, 358, 417–419, 423, 425, 428, 443–452, 454, 491–493

(56) References Cited

U.S. PATENT DOCUMENTS 4,520,577 A * 6/1985 Suissa ..... 34/76

4,765,159 A * 8/1988 Maeda et al. ..... 68/12.08

(List continued on next page.)

FOREIGN PATENT DOCUMENTS

| | | |
|---|---|---|
| DE | 29 15 735 | 11/1980 |
| DE | 199 07 789 | 9/1999 |
| EP | 0 959 173 | 11/1999 |
| GB | 1 000 055 | 8/1965 |

OTHER PUBLICATIONS

Patent Abstracts of Japan vol. 018, No. 071 (C–1162), Feb. 7, 1994 –& JP 05 285297 A (Sanyo Electric Co Ltd), Nov. 2, 1993 *abstract; figures*.

*Primary Examiner*—Ira S. Lazarus
*Assistant Examiner*—Andrea M. Ragonese
(74) *Attorney, Agent, or Firm*—Guido Modiano; Albert Josif; Daniel O'Byrne

(57) ABSTRACT

The method for safety control of the drying cycle in hydrocarbon-solvent dry-cleaning machines, comprising, in the first step of the drying cycle, when the temperature of the mixture of hot air and solvent at the outlet of the drying drum reaches values which are higher than a preset safety value passing, the drying air, before being returned to the drum, through an additional separator-heat exchanger having a high thermal capacity. The apparatus is constituted in particular by the additional separator-heat exchanger connected through at least one valve driven by a detection to the drying circuit of the machine.

9 Claims, 3 Drawing Sheets

U.S. PATENT DOCUMENTS 4,769,921 A * 9/1988 Kabakov et al. ..... 34/469
4,800,655 A * 1/1989 Mori et al. ..... 34/77
4,802,253 A * 2/1989 Hagiwara et al. ..... 8/158
4,813,247 A * 3/1989 Takeda ..... 68/142
4,817,296 A * 4/1989 Kabakov et al. ..... 34/77
4,912,793 A * 4/1990 Hagiwara ..... 8/158
5,056,174 A * 10/1991 Hagiwara ..... 68/18 C
5,195,252 A * 3/1993 Yamada et al. ..... 34/470
5,219,371 A * 6/1993 Shim et al. ..... 34/467
5,301,379 A * 4/1994 Schaal ..... 68/18 C
5,357,771 A * 10/1994 Schaal ..... 34/601
5,367,787 A * 11/1994 Ikeda et al. ..... 34/549
5,423,921 A * 6/1995 Saal et al. ..... 134/10
5,467,492 A * 11/1995 Chao et al. ..... 68/183
5,498,266 A * 3/1996 Takagawa et al. ..... 8/142
5,586,456 A * 12/1996 Takagawa et al. ..... 68/18 R
5,689,848 A * 11/1997 Saal et al. ..... 8/159
5,713,138 A * 2/1998 Rudd ..... 34/124
5,724,750 A * 3/1998 Burress ..... 34/267
5,887,454 A * 3/1999 Renzacci ..... 68/18 C
5,901,462 A * 5/1999 Rudd ..... 34/122
5,943,720 A * 8/1999 Chung ..... 68/18 C
5,953,833 A * 9/1999 Rudd ..... 34/219
6,021,652 A * 2/2000 Walker ..... 137/554
6,050,112 A * 4/2000 Walker ..... 68/12.21

* cited by examiner

METHOD AND APPARATUS FOR SAFETY CONTROL OF THE DRYING CYCLE IN HYDROCARBON-SOLVENT DRY-CLEANING MACHINES

BACKGROUND OF THE INVENTION

The present invention relates to a method and an apparatus for safety control of the drying cycle in hydrocarbon-solvent dry-cleaning machines.

Dry-cleaning machines are known which use as solvent, instead of perchloroethylene, a group of petroleum-derived solvents formulated appropriately for dry-cleaning, particularly paraffin hydrocarbons such solvents are becoming widely used due to their low environmental impact.

Solvents of the hydrocarbon group suffer drawbacks due to danger of explosion under certain conditions: above a certain temperature level, known as flash point, if the concentration of the solvent in the air is between two values, known as lower and upper explosion limits, which are specific for that particular type of solvent, if a spark occurs the mixture of air and solvent can explode.

Situations entailing the danger of explosion occur in practice during the drying cycle, during which hot air is introduced in the washing drum that contains the moist laundry in order to extract the solvent from the laundry: the hot air, saturated with solvent, is passed through a cooling radiator, where the solvent condenses and is separated from the mixture; then the air is heated again in a heating radiator and returned to the drum.

It is known in the art to provide a portion of drying circuit in which the outlet of the drum is connected to a cooling radiator of a refrigeration unit, to a heating battery and then to the inlet of the drum. In order to provide safety control over the possibility of explosion of the dry-cleaning machine, it is known to install, at the outlet of the drum, a device for measuring the concentration of solvent; in certain machines, the concentration measurement device operates the shutdown of the heater when particular values of concentration, linked to the measurement of the temperature of the air-solvent mixture at the outlet of the drum, are exceeded.

However, these dry-cleaning machines suffer the drawback that at the beginning of the drying cycle, when the presence of the solvent and the danger of explosion are the highest and when it would be necessary to cool rapidly and more efficiently the mixture of air and hydrocarbons, which is too rich in hydrocarbons, the effectiveness of the system for cooling and therefore separating the solvent from the air is inadequate; in order to avoid the danger of explosion, one is forced to mainly act only on the interruption of the heating of air before returning it to the washing drum, and this leads to an undue increase in drying times.

Moreover, concentration detection devices for known dry-cleaning machines are rather expensive and delicate and have relatively long response times.

SUMMARY OF THE INVENTION

The aim of the present invention is to obviate the above mentioned drawbacks of the prior art and meet the mentioned requirements, by providing a method for safety control of the drying cycle in hydrocarbon-solvent dry-cleaning machines which avoids reaching dangerous concentrations of hydrocarbons, speeds up the drying cycle and provides a corresponding apparatus which is extremely reliable, not delicate and having very rapid response times.

Within this aim, an object of the present invention is to provide a method and an apparatus which is simple, relatively easy to provide in practice, safe in use and effective in operation.

This aim and these and other objects which will become better apparent hereinafter are achieved by the present method for safety control of the drying cycle in hydrocarbon-solvent dry-cleaning machines, characterized in that in the first step of the drying cycle, when the temperature of the mixture of hot air and solvent at the outlet of the drying drum reaches values which are higher than a preset safety value, the air, before being returned to the drum, is passed through an additional separator-heat exchanger having a high thermal capacity.

The apparatus for carrying out the method of the invention is characterized in that it comprises an additional heat exchanger having a high thermal capacity, which is connected to the drying circuit of the machine by way of at least a valve which is driven by a detector for detecting the temperature of the air-solvent mixture that leaves the drum, at least part of the drying air being passed, above a preset temperature, through the additional exchanger instead of through the drum.

BRIEF DESCRIPTION OF THE DRAWINGS

Further characteristics and advantages of the present invention will become better apparent from the detailed description of a preferred but not exclusive embodiment of the method for safety control of the drying cycle in hydrocarbon-solvent dry-cleaning machines and of an apparatus according to the invention, illustrated only by way of non-limitative example in the accompanying drawings, wherein.

DESCRIPTION OF THE PREFERRED EMBODIMENTS

Figure 1A:
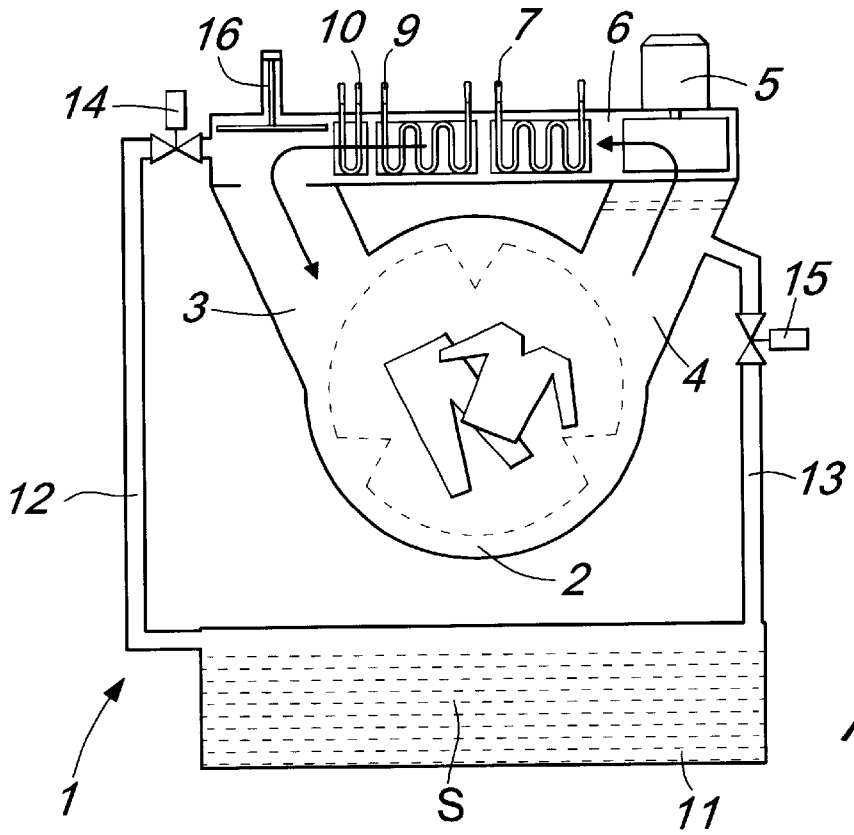
FIGS. 1*a*, 1*b* and 1*c* are schematic side views of a machine illustrating different steps of the method for safety control of the drying cycle in hydrocarbon-solvent dry-cleaning machines, according to the invention.

With reference to the figures, the reference numeral 1 generally designates a hydrocarbon-solvent dry-cleaning machine of the type provided with a washing and drying drum 2, having an intake duct 3 and a discharge duct 4 for the drying air, which is circulated in a closed-circuit arrangement by an aspirator 5 in an upper duct 6, in which a condenser 7 of a refrigeration unit operates, condensing the solvent, which is evacuated from the duct through the discharge tube 8, a first heat exchanger 9 and an optional second heat exchanger 10, which increase the temperature of the air before returning it to the drum (the air is returned warm to increase the effectiveness of the extraction of the solvent from the laundry that is present in the drum).

The apparatus according to the invention comprises an additional heat exchanger 11 having a high thermal capacity which is connected to the drying circuit of the machine by means of two pipe portions 12, 13 being controlled by a valve 14 and a valve 15; a throttling valve 16 is fitted between the duct 3 and the duct 6 and controls the flow of air before it enters the drum.

A temperature detector 17 is mounted in the discharge duct 4 and is connected to a unit for driving the valves 14, 15 and 16. Above a preset temperature, at least part of the drying air is sent by the valves into the additional heat exchanger 11 instead of into the drum.

During the first step of the drying cycle, when the temperature of the hot air-solvent mixture leaving the drying drum reaches values that exceed a preset safety value, the drying air, before being returned to the drum, is passed through the additional heat exchanger and separator 11, which has a high thermal capacity.

Figure 1B:
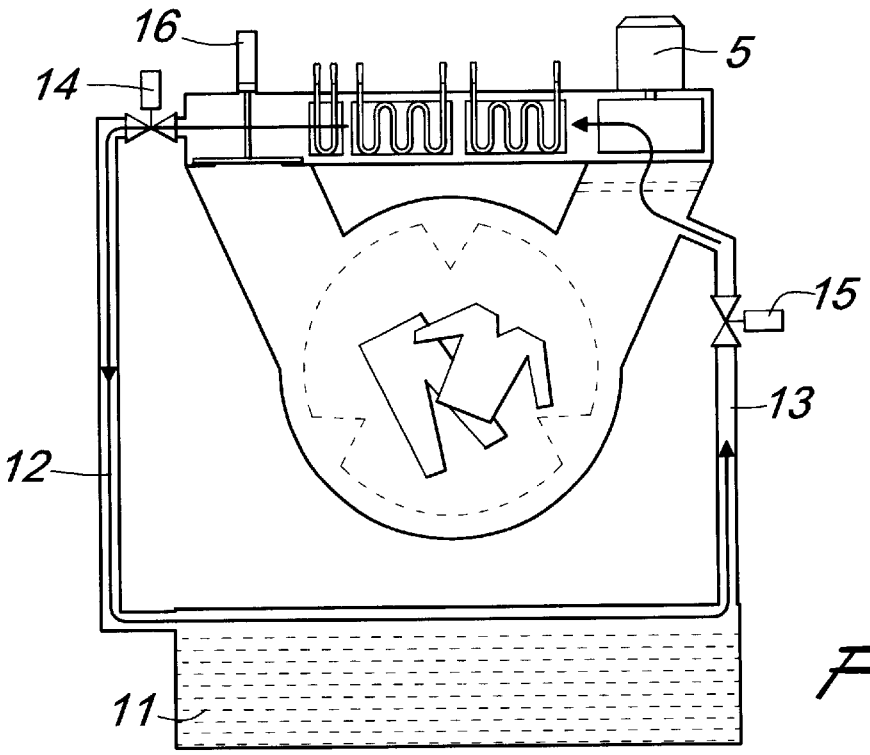

In the figures, FIG. 1*a* illustrates a step of the drying cycle in which all the air circulates in the drum and in the duct 6; FIG. 1*b* illustrates a step in which all the drying air is sent to flow over the free surface of the cold solvent contained in 11; and FIG. 1*c* illustrates a step in which part of the air is sent into the drum and part is sent into the tank 11.

Figure 1C:
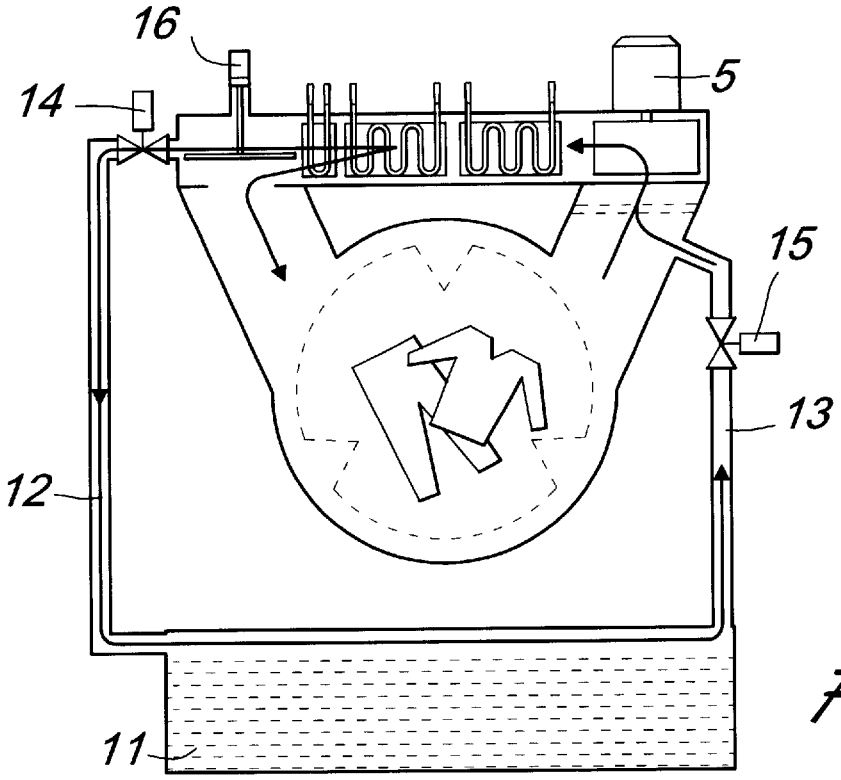
Figure 2:
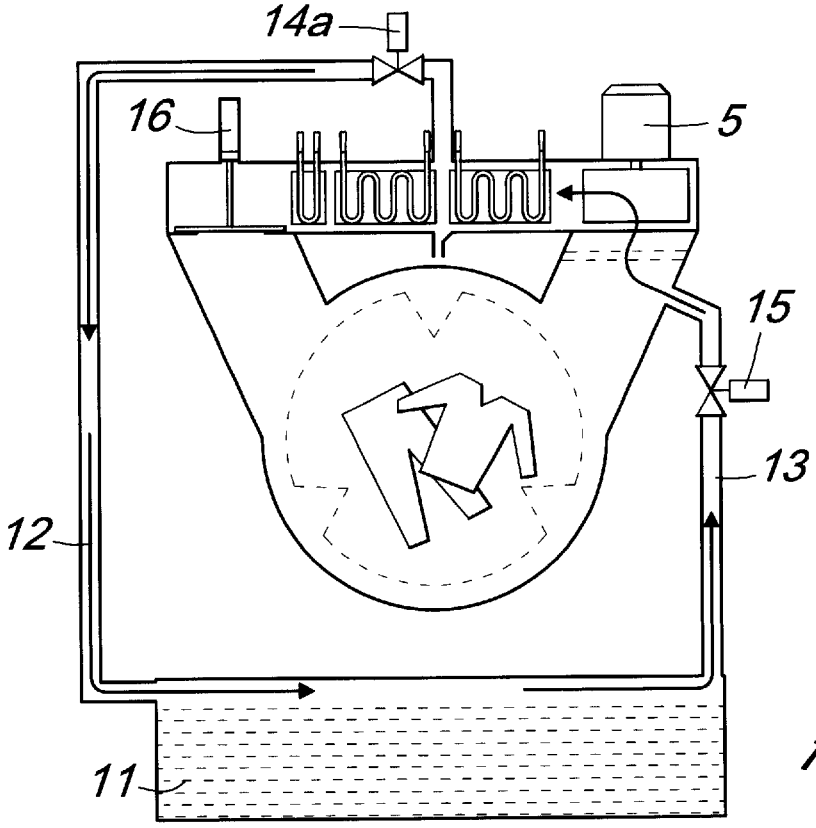
FIG. 2 is a schematic side view of a machine which is slightly different from the one shown in FIGS. 1*a* to 1*c* but performs the same method.
Figure 3:
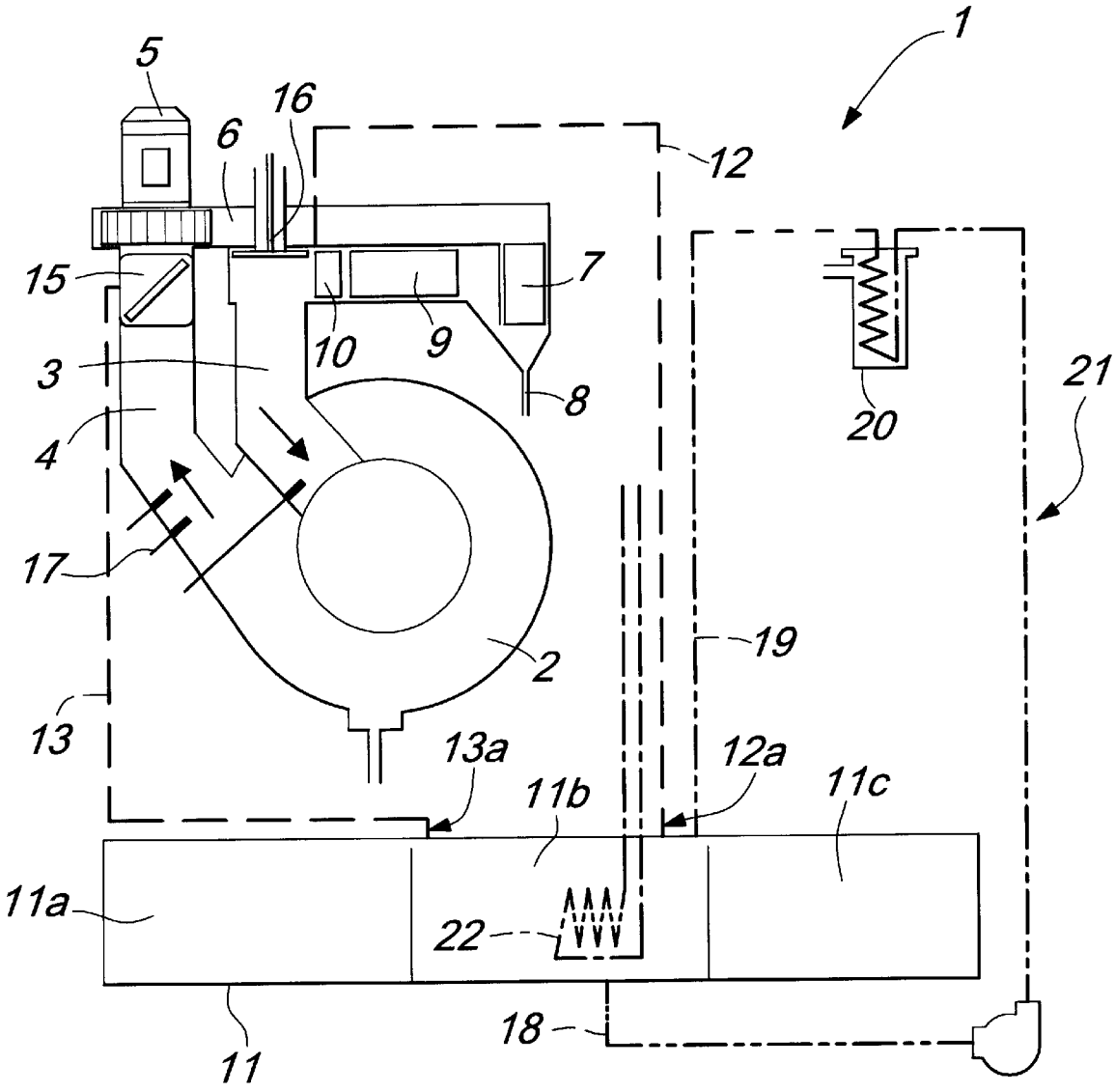
FIG. 3 is a schematic view of the details of a dry-cleaning machine, illustrating the apparatuses that cooperate for carrying out the method.

FIG. 2 illustrates an embodiment different from that shown in FIGS. 1*a*–1*c*; namely the pipe 12, with the corresponding valve 14*a*, is connected to the duct 6 in a point which lies between the condenser 7 and the first heat exchanger 9.

The exchanger 11 is constituted by the solvent containment chamber or tank (formed by three chambers 11*a*, 11*b* and 11*c* which are interconnected in a known manner by means of ducts and valves, not shown in the figure) of the dry-cleaning machine, which is conveniently provided with low-temperature cooling means.

The tank 11 has an outlet 18 and an inlet 19 for the solvent in the liquid phase which are connected to a cooling unit 20 designed to lower the temperature of the solvent in a distillation circuit 21 during the distillation step of the dry-cleaning machine.

A cooling coil 22, operated by a refrigeration unit of the machine, is immersed in the tank 11.

The inlet 12*a* for introducing, through the pipe 12, a mixture of hot air and solvent, and the outlet 13*a* for discharging, through the pipe 13, cooled air in the gaseous phase are provided in the upper region of the tank 11: solvent removal and air cooling occur by making the mixture of hot air and solvent arriving from the drum to flow over the free surface of the cold solvent S contained in the tank.

In certain known hydrocarbon-solvent dry-cleaning machines, the process is as follows: in a closed circuit, during the drying cycle, the temperature of the air-solvent mixture and the concentration of the mixture are measured at the outlet of the drum; if such concentration reaches dangerous values, the heating unit (which heats the air circulating in the closed drying circuit before returning it to the drum) is halted before sending it again to the drum. When the solvent concentration drops to safe values, the air is heated again before returning it to the drum, so as to better extract the solvent from the laundry that is present in the drum: a sequence of activations and shutdowns of the air heater is produced which causes a great waste of time because it takes a certain time to reduce and then raise the temperature of the air heater.

The principle of the method according to the invention is different; instead of monitoring the concentration, only the temperature at the outlet of the drum is monitored; as soon as the temperature exceeds the preset value (i.e., the temperature below which explosion is not possible regardless of the concentration), all or part of the air of the closed drying cycle, before being returned to the drum, is passed through an auxiliary cooling unit having a high thermal capacity: this unit removes the solvent that is present in the air-solvent mixture and returns to the drum a flow of solvent-free cold air which reduces the temperature to acceptable values: it is not necessary to cope with the inertia of the drying cycle heater, and a large "quick tank" of additional cold also capable of reducing the presence of solvent, is used instead.

In order to cool and remove the solvent, it has been found that it is particularly effective to make the hot air-solvent mixture flow over the free surface of the tank that contains the solvent, which is appropriately cooled (in certain perchloroethylene dry-cleaning machines, the solvent cooled to a low temperature is used instead of water for the step of distilling the solvent with a tank cooling apparatus and connections to the distillation cycle which are similar to the ones that can be adopted now for different purposes).

It has thus been observed that the method and the apparatus according to the invention both achieve the intended aim and objects.

The invention thus conceived is susceptible of numerous modifications and variations, all of which are within the scope of the inventive concept.

All the details may furthermore be replaced with other technically equivalent ones.

In practice, the materials used, as well as the shapes and dimensions, may be any according to requirements without thereby abandoning the scope of the protection of the appended claims.

The disclosures in Italian Patent Application No. BO2000A000337 from which this application claims priority are incorporated herein by reference.

What is claimed is:

1. In a dry cleaning machine provided with a washing and drying drum, drying air intake and discharge ducts connected, respectively to an inlet and to an outlet of the drum, a dosed drying circuit, a solvent condenser, at least one heat exchanger for increasing air temperature before returning thereof to the drum, a drying safety control apparatus comprising:

at least one temperature detector located at the discharge duct for monitoring temperature of to air-solvent mixture at the outlet of the drum;

at least one control valve driven by said at least one temperature detector;

an additional separator-heat exchanger with high thermal capacity for cooling the air solvent-mixture, separating solvent from said mixture and returning to the drum solvent-free cooled air; and wherein said additional separator heat exchanger comprises an ak-solvent mixture inlet and a cooled air outlet connected, respectively, through first and a second pipe portions controlled by said at least one control valve, to the drying circuit, said at least one valve being driven by said at least one temperature detector to enable, above a preset temperature of the air-solvent mixture, conveyance of at least part of the air-solvent mixture from the drying circuit into said additional separator-heat exchanger, separation of solvent from the air-solvent mixture, cooling of the air and conveyance of cooled air, Through said outlet of the separator-heat exchanger back into to drum for lowering temperature of the air-solvent mixture under said preset temperature.

2. The apparatus of claim 1, wherein said separator-heat exchanger is constituted by a solvent containment tank which comprises cooling means for cooling hot air and solvent to a low temperature.

3. The apparatus of claim 2, wherein said cooling means comprise a cooling unit for reducing temperature of the solvent during distillation, and a cooling coil immersed in the tank, said tank having an outlet and an inlet for the solvent in the liquid phase which are connected to said cooling unit.

4. The apparatus of claim 3, wherein said inlet for the air-solvent mixture and said outlet for the cooled air in gaseous phase are located in an upper region of said tank, and wherein separation of the solvent and air cooling is provided by flowing from said inlet to said outlet of said tank, said at least part of the air-solvent mixture from the drum, over a free surface of the cold solvent contained in the tank.

5. The apparatus of claim 2, wherein said tank is formed by three chambers which are interconnected.

6. In a dry cleaning machine provided with a washing and drying drum, drying air intake and discharge ducts connected, respectively to an inlet and to an outlet of the drum, a closed drying circuit, a solvent condenser, at least one heat exchanger for increasing air temperature before returning thereof to the drum, a drying safety control apparatus comprising:

at least one temperature detector located at the discharge duct for monitoring temperature of the air-solvent mixture at the outlet of the drum;

at least one control valve driven by said at least one temperature detector;

an additional separator-heat exchanger with high thermal capacity for cooling the air solvent-mixture, separating solvent from said mixture and returning to the drum solvent-free cooled air; and wherein said additional separator heat exchanger comprises an air-solvent mixture inlet and a cooled air outlet connected, respectively, through first and a second pipe portions controlled by said at least one control valve, to the drying circuit and cooling means for cooling said mixture and provide said cooled air, said at least one valve being driven by said at least one temperature detector to enable, above a preset temperature of the air-solvent mixture, conveyance of at least part of the air-solvent mixture from the drying circuit into said additional separator-heat exchanger, separation of solvent from the air-solvent mixture, cooling of the air and conveyance of cooled air, through said outlet of the separator-heat exchanger back into the drum for lowering temperature of the air-solvent mixture under said preset temperature.

7. The apparatus of claim 6, wherein said additional separator-heat exchanger is constituted by a tank containing cold solvent, said cooling means comprising a free surface of said cold solvent contained in the tank, said mixture being flown over said solvent free surface in order to lower the temperature thereof.

8. A method for safety control of a drying cycle in a hydrocarbon-solvent dry-cleaning machine wit a drying drum and a drying circuit, as set forth in claim 1, the method comprising providing an additional separator-heat exchanger having a high thermal capacity and an air-solvent mixture inlet and a cooled air outlet connected to the drying circuit through a first and, respectively, a second pipe portion controlled by at least one control valve which is driven by at least one temperature detector located at the discharge duct of the drying drum;

monitoring, during the drying cycle, temperature of the air solvent mixture by way of said at least one temperature detector, providing actuation of said at least one control valve, upon detection by way of said at least one temperature detector of a temperature of the air-solvent mixture above a preset safety temperature, such as to enable at least part of the air-solvent mixture to flow into said additional separator-heat exchanger; and providing, in said additional seperator-heat exchanger, a cooling of the air-solvent mixture, separation of solvent from the air-solvent mixture and cooling of the air;

conveying the cooled air,through the outlet of the separator-heat exchanger back into the drum and lowering temperature of the air-solvent mixture under said preset safety temperature.

9. The method of claim 8, wherein the cooling of the air-solvent mixture in said separator-heat exchanger comprises flowing the air-solvent mixture over a free surface of cold solvent contained in the separator-heat exchanger in order to lower the temperature thereof, separate the solvent from the mixture and provide cooled solvent-free air.

* * * * *